United States Patent [19]

Hartigan, Jr.

[11] 4,097,652

[45] Jun. 27, 1978

[54] POLY (ETHYLENE OXIDE) MONOFILAMENT

[75] Inventor: Richard Joseph Hartigan, Jr., Delmar, N.Y.

[73] Assignee: Albany International Corp., Albany, N.Y.

[21] Appl. No.: 608,666

[22] Filed: Aug. 28, 1975

[51] Int. Cl.[2] ..... D01D 5/10

[52] U.S. Cl. ..... 428/401; 260/2 A; 264/210 F

[58] Field of Search ..... 260/2 A; 264/210 F; 428/401

[56] References Cited

U.S. PATENT DOCUMENTS

| | | | |
|---|---|---|---|
| 3,062,755 | 11/1962 | Mill et al. | 260/2 |
| 3,377,261 | 4/1968 | Ancker | 204/159.14 |
| 3,532,645 | 10/1970 | Schulze et al. | 260/2 |

OTHER PUBLICATIONS

Encyclopedia of Polymer Science & Technology, Interscience, 1967, vol. 6, p. 508; vol. 8, pp. 397 and 398.

Hopff et al., "Poly (ethylene oxide) Fibers", Chemical Abstracts 62, 5373e (1965).

*Primary Examiner*—Harold D. Anderson
*Assistant Examiner*—E. A. Nielsen
*Attorney, Agent, or Firm*—Kane, Dalsimer, Kane, Sullivan and Kurucz

[57] ABSTRACT

Poly (ethylene oxide) monofilaments together with their preparation and use are disclosed. The monofilaments are characterized in part by their properties which are useful for weaving or sewing and by their solubility in a wide variety of solvents including water at room temperatures. The monofilaments of the invention are useful in weaving as temporary binder yarns and as basting threads.

3 Claims, 3 Drawing Figures

POLY (ETHYLENE OXIDE) MONOFILAMENT

BACKGROUND OF THE INVENTION

1. Field of the Invention

The invention concerns poly (alkylene oxide) polymers and their processing into shaped forms. More particularly the invention concerns poly (ethylene oxide) homopolymer monofilaments, their preparation and use in weaving and sewing fabrics.

2. Brief Description of the Prior Art

Poly (ethylene oxide) homopolymers are well known as is their preparation and use for a variety of purposes; see for example U.S. Pat. Nos. 2,897,178; 2,982,742; 3,030,231; 3,154,514; 3,167,519; 3,316,676; 3,328,916; 3,377,261; 3,465,070; 3,470,078; and 3,766,101. Although a wide variety of uses are disclosed in the prior art for poly (ethylene oxide) homopolymers they have not, prior hereto, been suggested as suitable monofilaments for any purpose whatsoever.

The production of monofilaments from many different classes of synthetic polymeric resins has been disclosed in numerous publications. For example, U.S. Pat. Nos. 3,084,991 teaches the production of poly (arylepoxy) ether monofilaments. Ethylene sulfide polymer monofilaments are described in U.S. Pat. No. 3,539,676. In U.S. Pat. No. 3,608,044 disclosure is made of monofilaments prepared from polyoxymethylene homopolymers and copolymers of polyoxymethylene-oxyethylene. In general however, none of the prior art procedures described are known to be suitable for producing satisfactory weaving yarns or threads from poly (ethylene oxide) homopolymers.

Poly (ethylene oxide) homopolymers are characterized in part by unique thermal behavior, crystal structure and extreme crystal instability in the presence of moisture. Prior hereto, their uses have been restricted by these properties to "humectants, thickeners or softeners" (U.S. Pat. No. 3,316,676) and like uses. The latter patent also describes such homopolymers as "normally unsuitable for films or molded objects." However, a number of techniques have been developed for extruding films of poly (ethylene oxide) homopolymers; see for example U.S. Pat. No. 3,328,916. However, the extruded films have not been suggested as useful for purposes requiring tensile strength, etc. Furthermore, the techniques of extruding the films have generally required modifying the homopolymer with additives such as plasticizers and the like because of brittleness. Generally such plasticizer additives degrade the desired properties of a monofilament, i.e.; tensile strength, elasticity etc.; see for example, U.S. Pat. No. 3,154,514 which comments at length on the poor "stress endurance," i.e.; crazing and tensile failure of poly (ethylene oxide) homopolymer film extrudates. In the latter patent, the problem is solved by copolymerizing the homopolymer with a substantial proportion of a wide variety of glycols to alter the polymeric backbone significantly. Such copolymerization of course alters the chemical nature of the extrudates in a major way and requires additional procedural steps.

By the process of the invention, one may prepare monofilaments of poly (ethylene oxide) homopolymers having properties which make the monofilaments useful as weaving yarns and sewing threads, removable from a finished fabric by dissolution in water.

Prior to the invention, the use of soluble yarns and threads as temporary binder yarns or basting threads had been known. Representative of the prior art are U.S. Pat. Nos. 2,714,758 and 3,137,864 which teach removing polyethylene basting yarns in hot wash water or by melting insitu. The disclosure of U.S. Pat. No. 2,539,244 includes the removal of cotton basting threads previously treated with dilute sulfuric acid by heating to disintegrate the thread. More recently U.S. Pat. No. 3,311,928 has described ethyl cellulose, polystyrene, polycarbonate and polystyrenemethylmethacrylate monofilaments or yarns which may be used as basting threads removable in dry cleaning solvents or aqueous acid or alkali mediums. Polyvinyl alcohol weft threads have been used in tire cord fabrics (U.S. Pat. No. 2,898,665) and subsequently removed by dissolution in water. According to the latter patent, dissolution times are generally prolonged unless the water is heated or the monofilament treated with glycerine. The latter expedient weakens the tensile strength of the yarn and is therefore undesired if the yarn is to be used in, for example, a weaving operation.

The use of the poly (ethylene oxide) monofilaments of the present invention in basting procedures or as temporary yarns in weaving fabrics is an improvement in the art because the monofilaments of the invention are removable very rapidly and completely even in cold untreated water. It is not necessary to add acid, alkali or other chemicals to the solvent water nor is it necessary to treat the yarns to weaken them. This is an economic advantage, saving of our natural resources, i.e.; energy, time and labor. The method leaves the finished fabric free of undesirable residues. The method of use is particularly useful in preparing temperature sensitive fabrics etc.

SUMMARY OF THE INVENTION

The invention comprises a monofilament of a poly (ethylene oxide) homopolymer having a molecular weight within the range of from 400,000 to 900,000. The monofilaments of the invention are completely soluble in a wide variety of solvents including water and are useful as basting threads and as removable or temporary binder yarns in weaving of textile fabrics.

The invention also comprises a process for making the monofilaments of the invention, which comprises;

- providing apparatus for thermally plasticizing and shaping said homopolymer, which comprises an extruder having a feed zone, a heating zone, a shaping zone and means for passing said homopolymer in successive stages through each of said zones, said zones being interconnected;
- feeding said homopolymer to said feed zone;
- continuously passing the fed homopolymer to the heat zone, said heat zone being maintained at a temperature above the first order phase transition temperature of said homopolymer, whereby said homopolymer is thermally plasticized;
- continuously passing the plasticized homopolymer to the shaping zone wherein said homopolymer is shaped in the form of a monofilament;
- continuously passing the shaped homopolymer into a quench bath which comprises a saturated aqueous solution of potassium carbonate maintained at a temperature within the range of from 70° to 90° F. whereby the shaped homopolymer is fixed in the form of an unoriented monofilament;
- removing said unoriented monofilament from the quench bath;

heating the unoriented monofilament to a temperature between the first and second order phase transition temperatures of said homopolymer;

stretching the heated unoriented monofilament to orient the molecules therein; and allowing the oriented monofilament to cool to ambient temperatures; said homopolymer having a molecular weight within the range of from 400,000 to 900,000.

The term "first order phase transition temperature" as used herein means the crystallite melting point. The term "second order phase transition temperature" as used herein means the glass-transition temperature. The term "thermally plasticized" is used to mean softening of the thermoplastic resin to an amorphous state by heat means.

The process of the invention is particularly advantageous in that it reproducibly provides monofilament of uniform properties.

The invention also comprises methods of using the monofilaments of the invention as temporary binder yarns in weaving and as basting threads.

BRIEF DESCRIPTION OF THE INVENTION

DETAILED DESCRIPTION OF THE INVENTION

Figure 1:
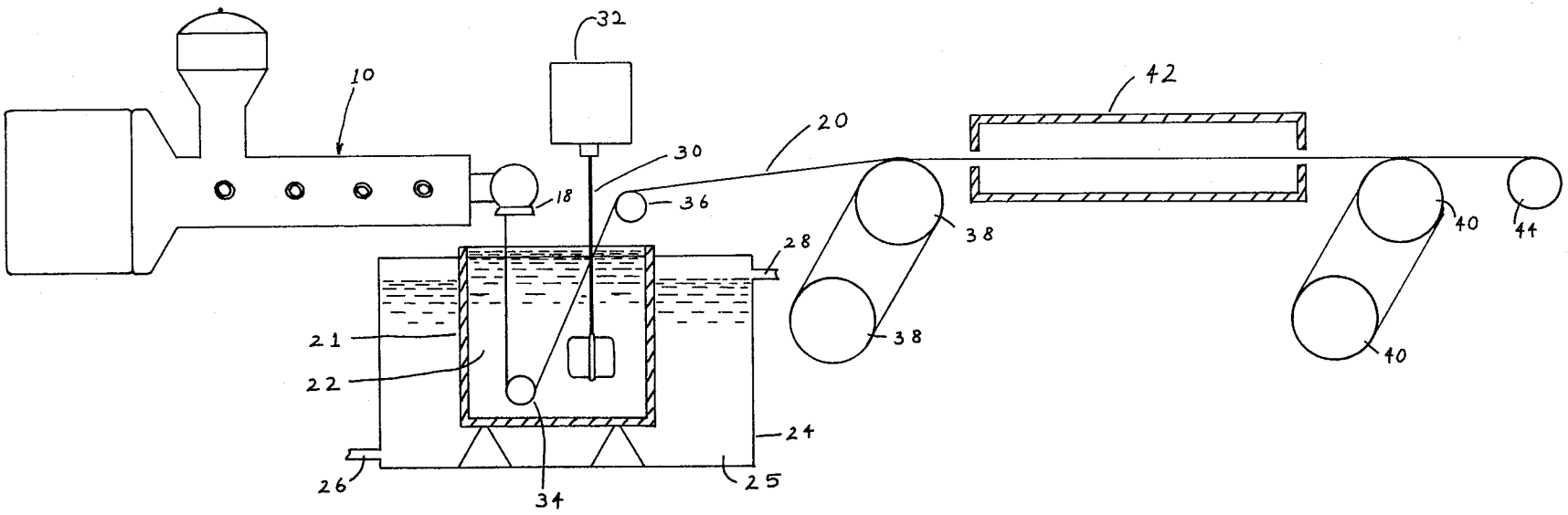
FIG. 1 is a schematic view illustrating an embodiment process of the invention.

The monofilaments of the invention are prepared from the homopolymer of poly (ethylene oxide) having a molecular weight within the range of from 400,000 to 900,000, preferably having an approximate average molecular weight of 600,000 as determined by rheological measurements. The preferred homopolymer may be further characterized in that it has a viscosity range of from about 4100 to 8000 cps when measured in aqueous solution (5% by weight, 25° C., using a model RVF Brookfield Viscometer with a No. 2 spindle at a speed of 2 RPM). It is important to the process of the invention, to reduce breaking of the monofilament being melt spun, that the homopolymer be substantially free of low molecular weight oligomers which may cause gel agglomerates in the melted homopolymer. One skilled in the art will know how to test for oligomer presence. A convenient and readily available method of determining whether a given lot of homopolymer is suitably free of oligomers and hence gel formation, is to melt and cast a representative film sample. The cooled casting will exhibit soft spots if gels have formed due to the presence of undesirable proportions of oligomers. The homopolymers are well known as is their preparation; see for example U.S. Pat. Nos. 2,982,742; 3,020,231 and 3,167,519. The preferred monofilaments of the invention have diameters ranging from 5 to about 15 mils, most preferably from 8 to about 12 mils. The monofilaments of the invention may be further characterized as having a denier of from about 530 to about 600, preferably 550 to 570; a tensile strength of at least 2.5 lbs./end, preferably at least 3.5; a tenacity of at least 2.0 gms/denier, preferably at least 3.0; a percent elongation of 40% at 1 gm/denier (preferably $<30\%$) and of about 65% at break (preferably $<60\%$) and complete solubility in water within 10 minutes (at 70° F.). From the above characteristics one skilled in the art will appreciate that the monofilaments of the invention are useful in weaving and sewing operations, having good mechanical properties of strength, elasticity, stiffness and like properties. The monofilaments of the invention are also useful in the form of multifilament yarns, plied or braided monofilaments and like forms which may be prepared therefrom.

In broad terms, the process of the invention may be carried out by shaping the homopolymer into a monofilament while in a thermoplastic state, quenching it in a particular bath to fix the desired shape and then orienting the molecules by stretching of the monofilament while in the non-crystalline state. Shaping the homopolymer may be readily carried out by melt spinning with the aid of a conventional screw-type monofilament extruder. In general, such apparatus comprises an enclosed tube having at least three interconnected zones, i.e.; zones so arranged that the exit from one zone leads directly to the entry port of the next zone, there being no conduits or other means of transporting fluids, interposed between the various zones. A means, generally a screw mounted axially within the tubular enclosure, provides for propelling a charge of homopolymer resin from zone to zone.

The first zone of the extruder is a feed zone. The feed zone comprises a chamber for receiving solid homopolymer, generally from a hopper. The feed zone is preferably cooled to prevent premature melting of homopolymer charged therein. Preferably the charge is in the form of tablets of pressed granular poly (ethylene oxide) homopolymer. The pressed tablets may include a conventional flow assisting agent or lubricant such as, for example, about 1.5 percent by weight of a fumed silica. Alternatively, the lubricant may be added separately with the tablets if so desired. According to the process of the invention, poly (ethylene oxide) homopolymer is charged to the feed zone and continuously passed by the propelling screw to a heat zone where the polymer is "melted" by heating to a temperature above the first order phase transition temperature of the homopolymer. Preferably the heat zone is divided into multiple sub-zones so that initial melting is carried out in a zone maintained at a temperature of from about 260° to 270° F. The molten polymer is then passed to a heat zone maintained at a temperature of from about 380° to 390° F. The molten homopolymer is then continuously passed to a shaping zone maintained, preferably, at a temperature of from about 380° to 395° F. and then extruded through the orifices of a spinneret. The spinneret may have from 10 to 20 orifices ranging in diameter from 0.032 to 0.04 inch to obtain the preferred monofilaments of 8 to 12 mil diameter.

As an illustration of operating conditions, the preferred monofilaments of the invention may be extruded from extruder apparatus having a one inch (I.D.) barrel and a length to diameter ratio of from 13:1 to 24:1 under a head pressure of from 3000 to 4000 psi and with a screw speed of from 20 to 100 RPM, preferably 50 to 60 RPM. The compression ratio should not be greater than 3:1. The use of screen packs and spin pumps in the monofilament extruder is within the scope of the process of the invention. However, in the preferred process, a spin pump is not utilized in the spinneret assembly and screen packs are not used since their presence is not conducive to smooth monofilaments and the continuous production of unbroken monofilament. Accordingly, it is desirable that the molten homopolymer used in the preferred process have a low gel content. To provide molten polymer of low gel content, the homopolymer charge should be relatively free of low molecular weight oligomers and aggregations of molecules above about 900,000 molecular weight.

Upon extrusion, the shaped homopolymer monofilament is quenched immediately in a saturated aqueous solution of potassium carbonate before any substantial exposure to air. The quench bath must be maintained at a temperature within the range of 70° to 90° F., preferably 70° to 80° F. Higher or lower temperatures will contribute to breaking of the shaped homopolymer. The nature of the bath, i.e.; an aqueous solution, saturated, of potassium carbonate is important and as the carbonate is removed from the solution by deposition on the surface of the monofilament, it must be replenished in the bath solution to maintain saturation. The use of non-aqueous bath mediums, such as ethylene glycol or silicone oils has not proven successful in the process of the invention since they tend to tackify the monofilament surface. Quenching in air tends to be detrimental to the strength of the monofilament and of course a water quench is impossible. It is advantageous to the properties of the monofilament if a uniform temperature profile in the quench tank is maintained. This is best accomplished by stirring the quench bath continually to obtain a mixing of the quench solution.

Referring now to FIG. 1, a schematic drawing of a preferred process embodiment of the invention there is seen an extruder 10 providing melt spinning of a monofilament 20 into a quench bath 22 of a saturated aqueous solution of potassium carbonate. The quench tank 21 is disposed in a cooling vessel 24 through which cooling water 25 is circulated via inlet 26 and outlet 28. The temperature of cooling water 25 is selected to balance the thermal input of the molten extrudate received by the quench bath 22. A stirrer 30 powered by motor 32 provides circulation of the quench bath 22. The distance between spinneret 18 and quench bath 22 is preferably less than 6 inches so that the molten homopolymer has minimal exposure to the air. The fixed-by-quench monofilament 20 is picked up by a grooved guide roller 34 in the bottom of quench tank 21 and carried under slight tension to guide roller 36 outside of the quench. The monofilament 20 is then taken up by a first Godet roller 38. A slight cold drawing may take place between roller 36 and Godet roller 38 due to the slight tension on the monofilament 20. The monofilament 20 is then drawn in a single draw through a dry air draw oven 42 capable of heating the traveling monofilament 20 to a temperature of between about 90° and 130° F. The draw is made by second Godet roller 40. The speed ratio of Godet 38 to Godet 40 is within the range of 5.0:1.0 to 5.5:1.0, preferably 5:1. This provides a stretch of about 500 to 550 percent to orient the molecules of the monofilament. The drawn monofilament 20 is then allowed to cool to ambient temperatures, i.e.; room temperatures, and taken up on spool 44. The cooled and spooled monofilament should be immediately packaged under a hermetic seal to prevent degradation by exposure to moisture.

Those skilled in the art will appreciate that a number of factors are critical to the success of preparing preferred monofilaments of the invention, i.e.; monofilaments exhibiting uniform characteristics of high tensile strength, diameter, shrinkage control, stretch under load and the like. The principle of such factors, many of which are obviously interrelated, include the speed of extrusion, the nature and temperature of the quench, the drawing or orienting conditions and the overall characteristics of the apparatus in which the process is carried out.

The following examples describe the manner and process of making and using the invention and set forth the best mode contemplated by the inventor of carrying out his invention but are not to be construed as limiting.

The test procedures used to characterize the monofilaments of the invention are as follows:

Percent of Elongation — ASTM Test Method D-638-58T

Tensile Strength — ASTM Test Method D-638-58T

Tenacity — The average Tensile Strength in pounds as measured by ASTM Test Method D-638-58T converted to grams and divided by the average yarn weight per unit length in denier (grams/9000 meters).

Example: Tensile Strength = 3.8 pounds force 3.8 lbs. × 453.6 grams/lb = 1723.7 grams force Tenacity, grams/denier = (1723.7 grams/548 denier) = 3.1 GPD M.I.T. Flex — Based on ASTM Folding Endurance Test Method D2176-63T, but modified for single yarns and monofilaments by welding 1/32 inch carbide rods to the tops of 0.06–0.07 inch gapped jaws.

EXAMPLE 1

The apparatus employed in carrying out the process described in this example is a conventional single stage screw mixer-extruder with a one inch (internal diameter), non-vented barrel. The length to diameter ratio is 20:1 and there are three heating zones including one at the extrusion head. The extrusion head is a 90° monofilament head without a spin pump. The spinneret has 10 monofilament holes, each hole having a diameter of 0.40 inch. No screen pack is employed.

In carrying out the continuous process of the invention, the hopper and feed section of the extruder is charged with tablets (11/32 inch diameter × 5/32 inch thickness) of poly (ethylene oxide) homopolymer (Polyox-WSR-205, Union Carbide Corp., New York, N.Y.; Bulletins F-44029A dated September 1973 and F-40246E). The homopolymer is characterized by an approximate average molecular weight of 600,000, a melting point of 150° ± 4° F., a specific gravity of 1.21, a heat of fusion of 33 cal./gm and an aqueous viscosity range of 4100–8000 CPS (5% aqueous solution, 25° C., Model RVF Brookfield Viscometer, Spindle No. 2 at 2 RPM).

Operating at extruder screw speeds of 50 and 55 RPM respectively, under a head pressure of circa 4000 psi, the charge is melted and moved to the initial heating zone maintained at 270° F. The melted charge progresses through the second heat zone maintained at 390° F. and on to the head which is maintained at 395° F. The melt is spun downward into a quench bath (positioned about 1 inch below the die) of a saturated aqueous solution of potassium carbonate maintained at a temperature of between 70° to 80° F. and taken up by a first Godet roller at a speed of about 25 feet per minute. The resulting monofilament is drawn through a draw heater operating at a temperature of circa 110° F. by a second Godet roller operating at a speed of 125 feet per minute, thereby giving a draw ratio of 5:1.

The monofilament produced is smooth and uniform. The product is immediately protected from humidity by packaging under hermetic conditions. The properties of the monofilaments obtained at each screw speed are given below in Table 1.

Table 1

| | Run No. 1 (50 RPM Screw Speed) | Run No. 2 (55 RPM Screw Speed) |
|---|---|---|
| Diameter (average) | 10.3 mils | 11.1 mils |
| Weight (gr/100 yds) | 86.4 | 93.6 |
| Denier | 551 | 597 |
| Tensile (lbs/end) | 3.4 | 3.9 |
| Tenacity (gms/den) | 2.8 | 3.0 |
| Percent Elongation at | | |
| 1 gm/den | 35.3 | 36.3 |
| Break | 56.6 | 59.0 |
| MIT Flex (cyclic; 500 gm wgt) | 134 | 187 |
| Cold water solubility (70° F.) | Disintegrates in 30 secs. complete solution in <10 minutes | Disintegrates in 20 secs. complete solution in <10 minutes |

EXAMPLE 2

Following the procedure of Example 1, Run No. 1 supra, except that the initial heating zone is maintained at a temperature of 290° F., the second heating zone at 400° F., the head at 430° F., and the quench bath at 70° F. there is obtained a monofilament having the following properties:

Diameter — 10.4 mils
Weight (gr/100 yds) — 86.0
Denier — 548
Tensile (lbs/end) — 3.8
Tenacity (gms/den) — 3.1
Percent Elongation at —
1 gm/den. — 33.0
Break — 65.4
MIT Flex (cycles; 500 gm wgt) — 206

The monofilaments prepared according to Examples 1 and 2, supra, may be woven into a textile fabric, for example as a weft yarn, to temporarily bind fabric layers. The monofilaments may also be used as basting threads in sewing operations, particularly after lubrication, for use with sewing machines. The temporary yarns or threads may be removed, when desired, by simply dipping the sewn of woven material in water or other solvent.

Poly (ethylene oxide) homopolymer is soluble in a wide variety of aqueous and organic solvents. For example, the homopolymer is soluble at room temperatures in acetonitrile, ethylene dichloride, carbon tetrachloride, trichloroethylene, methylene dichloride, benzene, isopropanol (91%), dimethyl formamide, benzaldehyde, tetrahydrofuran, ethylene carbonate, methanol, methyl ethyl ketone and water. Any of the above solvents, and preferably water, may be used to dissolve the monofilaments of the invention.

EXAMPLE 3

Figure 2:
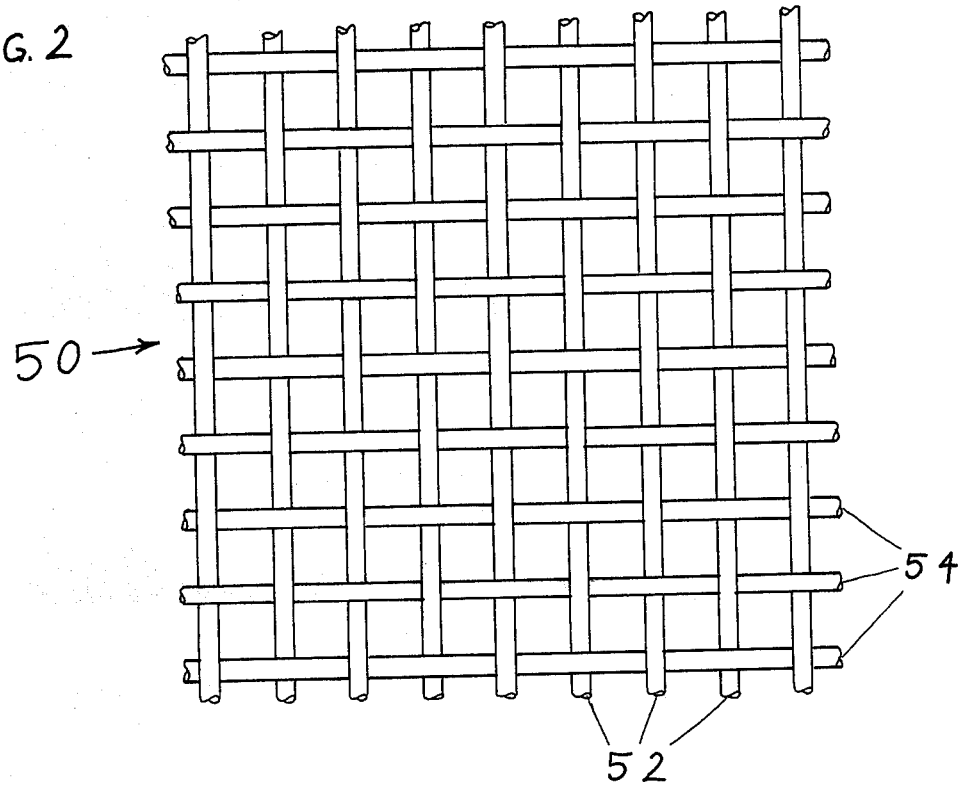
FIG. 2 is a fragmentary perspective view of a fabric made with monofilaments of the invention.
Figure 3:
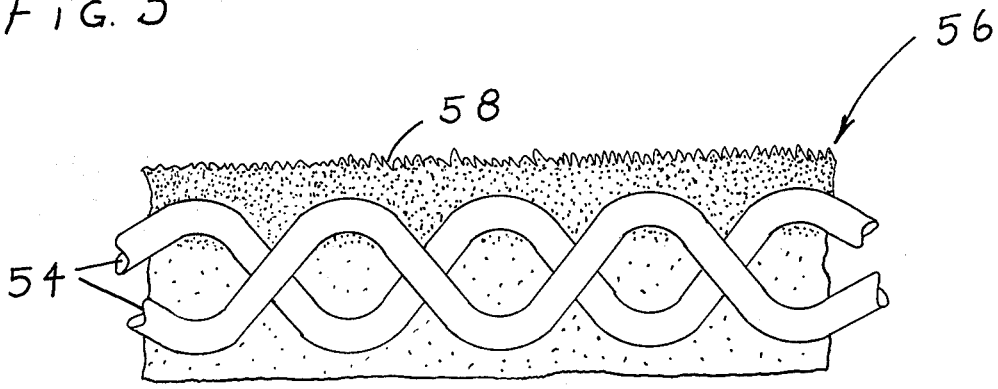
FIG. 3 is a partial cross-sectional side elevation of a needled fabric as shown in FIG. 2 after removal of the monofilaments of the invention.

A base fabric 50 is woven in a plain weave as shown in FIG. 2, (a fragmentary view in perspective) employing a poly (ethylene oxide) homopolymer monofilament prepared according to any of Examples 1 and 2, supra as the crosswise yarn 52. The lengthwise yarns 54 are nylon although any other conventionally employed yarn may be used. A synthetic fiber batt is then needled into the base fabric. The needled fabric is then formed and finished by conventional technique. The finished fabric is then immersed in water at room temperature for 10 minutes to dissolve the crosswise yarns 52. The needled felt 56 (see FIG. 3, a cross-sectional side elevation of the needled fabric shown in FIG. 2) is removed from the water and dried. As shown in FIG. 3, the product felt 56 consists of the fibrous needled batt 58 supported solely by lengthwise yarns 54. The felt 56 is particularly useful as a press felt fabric since the removed crosswise yarns 52 enhance the water removing capability of the fabric.

What is claimed is:

1. A monofilament of a poly (ethylene oxide) homopolymer having a molecular weight within the range of from 400,000 to 900,000, said monofilament being characterized by a diameter of from 5 to 15 mils and a tenacity of at least 3.0 gms./denier.

2. The monofilament of claim 1 wherein said homopolymer has an approximate average molecular weight of 600,000.

3. The monofilament of claim 1 having a diameter of from 8 to 12 mils, a denier of from about 530 to about 600, a tensile strength of at least 2.5 lbs/end and a percent elongation at 1 gm/denier of at least about 40% and at break of at least about 65%.

* * * * *